United States Patent [19]

Herner

[11] Patent Number: 4,825,746

[45] Date of Patent: May 2, 1989

[54] UNIVERSAL POWER CYLINDER

[75] Inventor: Ray H. Herner, Brookville, Ohio

[73] Assignee: Mosier Industries, Incorporated, Brookville, Ohio

[21] Appl. No.: 168,999

[22] Filed: Mar. 16, 1988

[51] Int. Cl.[4] ..... F15B 15/26

[52] U.S. Cl. ..... 91/45; 91/44; 92/23; 92/88; 188/271; 188/67

[58] Field of Search ..... 92/56, 23, 24, 27, 28, 92/88, 18; 91/41, 43, 44, 45; 188/271, 67, 265, 129

[56] References Cited

U.S. PATENT DOCUMENTS

| | | | |
|---|---|---|---|
| 2,532,768 | 12/1950 | Halward | 91/44 |
| 2,928,507 | 3/1960 | Thompson | 188/271 |
| 3,054,478 | 9/1962 | Rumsey | 188/271 |
| 3,264,943 | 8/1966 | Schmitt | 92/28 |
| 3,398,651 | 8/1968 | Folmer | 188/67 |
| 3,422,505 | 1/1969 | Slemmons | 188/67 |
| 3,695,144 | 10/1972 | Goiffon et al. | 188/67 |
| 3,779,135 | 12/1973 | Sugimura | 91/45 |
| 3,989,112 | 11/1976 | Cole et al. | 91/45 |
| 4,534,269 | 8/1985 | Scerbo et al. | 92/23 |
| 4,588,054 | 5/1986 | LeBaron | 92/185 |

FOREIGN PATENT DOCUMENTS

| | | | |
|---|---|---|---|
| 2519386 | 7/1983 | France | 92/28 |
| 0289228 | 3/1971 | U.S.S.R. | 92/28 |
| 0629884 | 9/1949 | United Kingdom | 91/43 |
| 0749695 | 5/1956 | United Kingdom | 92/28 |
| 1188100 | 4/1970 | United Kingdom | 92/28 |

*Primary Examiner*—Robert E. Garrett
*Assistant Examiner*—Thomas Denion
*Attorney, Agent, or Firm*—Jerome P. Bloom

[57] ABSTRACT

Power cylinder comprising a housing having a throughbore capped by end plates defining therein a longitudinally extending chamber. A piston including a longitudinally extending body portion mounts for reciprocal movement in and in bearing relation to the portion of the wall surface which bounds the length of said chamber. The piston has a longitudinally extended through passage and brake means immediately of its outer peripheral surface. A valve device associated with the piston body includes a portion thereof in communication with the through passage. The housing has ports respectively communicating with respective end portions of the chamber for selective delivery thereto and discharge therefrom of fluid under pressure and the selective application of such fluid under pressure to one or both ends of the piston. The valve portion associated with the through passage is constructed and arranged (1) to respond to fluid under pressure applied to one end of the piston to provide a closing of its through passage and prevent movement of applied fluid therethrough as the piston is moved thereby to the remote end of the chamber and (2) to respond to simultaneous application of pressure fluid to both end portions of the piston to place the so applied pressure fluid in communication with said brake means to activate and substantially simultaneously lock portions thereof to that portion of the chamber wall surface which is then in peripherally bounding realtion thereto.

16 Claims, 10 Drawing Sheets

14'
19'
20'
97
12
11
32
59
62
34'
90
102
100
36
49
35
52
16
93
31
38'
30'
18
20
19
13'

14'
11
97
95
100
16
11
13'

13'
32'
61
97
62
12
96
11

46
71
102
38
97
96
93
95
100
90
74
45

UNIVERSAL POWER CYLINDER

BACKGROUND OF THE INVENTION

This invention relates to a new and improved power cylinder constituting a linear motor featuring a self contained braking system embodiments of which are comprised of elements which have a most simplistic composition and interrelation which not only renders them most economical and simple to fabricate, assemble and maintain but also provides them with an extremely high degree of efficiency, effectiveness, durability and versatility in their use and enables their substantially universal application.

The invention is a most positive reponse to and provides the ultimate and most effective solution of a long standing problem, namely the existing need for more simplistically contrived and more reliable fluid operated controls capable of providing precision timing, sequence of function and increments of movement of interrelated and interacting elements of robotic, material handling, material processing and like systems.

In fact the features and benefits of this invention are that significant as to provide a new generation of fluid operated power cylinders which, as compared to prior art devices having similar application, are commonly characterized by a substantial reduction in their cost and an equal and higher level of performance and reliability in their use.

So that one may more particularly comprehend the state of the prior art in the relevant field of the invention, attention is directed to the inventor's presently co-pending U.S. patent application Ser. No. 07033,112 filed 03/03/87 for POWER CYLINDER and the discussion thereof therein.

SUMMARY OF THE INVENTION

One embodiment of the invention provides a substantially universally applicable power cylinder comprising a housing having a throughbore capped by end plates to define therein a longitudinaly extending chamber. A piston having a longitudinally extending body portion mounts for reciprocal movement in and in bearing relation to the portion of the wall; surface which bounds the length of said chamber. This piston features a longitudinally extended through passage and embodies brake means and a valve device a portion of which is associated with the through passage. The housing has ports respectively communicating with respective end portions of the chamber for the selective delivery thereto and discharge therefrom of fluid under pressure and the selective application of such fluid under pressure to one or both ends of the piston. The valve portion associated with the through passage is constructed and arranged (1) to respond to fluid under pressure applied to one end of the piston to block its through passage and prevent movement of applied fluid therethrough as the piston is moved thereby to the remote end of the chamber and (2) to respond to simultaneous application of pressure fluid to both end portions of the piston to place the so applied pressure in communication with said brake means to activate said brake means to substantially simultaneously lock said piston assembly to that portion of the chamber wall surface which is then in peripherally bounding relation thereto.

Another embodiment of the invention comprises a longitudinally extending shell-like tubular housing the ends of which are capped to define therein an axailly extended chamber mounted for reciprocation in bearing relation to the peripherally bounding wall of which is a piston assembly including a piston body which embodies brake means and is further distinguished by a longitudinally extending through passage. A section of the length of this passage is bridged by valve means operatively related to said brake means. Such valve means includes a tubular valve housing mounted for reciprocal movement within and in bearing relation to a portion of the inner wall surface of which is an intermediate portion of the length of a shuttle type valving device the cross section of which is such to define with its bounding wall surface at least one path for flow of fluid therebetween. This shuttle device includes means which in response to the introduction of fluid under pressure to one or the other end of said chamber and its application to one end of the piston assembly produces a seal across said through passage as the piston assembly moves toward the opposite end of the chamber and in response to the simultaneous application of fluid under pressure to both ends of the piston assembly is conditioned to direct portions of the applied fluid which resulting simultaneouslsy flow into said through passage from both ends thereof to substantially simultaneously therewith activate said brake means and fix said piston assembly against further movement.

In a preferred embodiment the brake means include new and improved inverted cup shaped braking elements which are nested inwardly of the outer surface of the piston body and communicated by radial bores formed in the piston body and extended through the valve housing with the path or paths defined between said intermediate portion of the length of the shuttle device and the bounding inner wall surface of the valve housing. Accordingly, as fluid under pressure is simultaneously applied to both ends of the piston assembly, there is, resultingly, a simultaneous pressured flow of portions thereof into the piston assembly through passage from each of the respective ends thereof conditioning said shuttle device to pass such flow, by way of said radial bores, to activate said brake means substantially simultaneously with the simultaneous application of said pressure fluid to both ends of the piston.

As will be obvious from the foregoing and the following detailed description and illustrative embodiment thereof, within its framework and limits the invention comprehends a multitude of applications and forms of its embodiment and their component parts as well as variations in the dispostion and mode of interrelation of such parts.

A primary object of the invention is to provide a more universally applicable fluid operated power cylinder.

Another object is to provide such a cylinder which is simpler and more economical to fabricate and assemble.

A further object is to provide a fluid operated power cylinder embodying a new and improved self contained brake system which as compared to the power cylinders of the prior art is more simplistic in construction and exhibits an extremely high degree of efficiency, effectiveness, durability and versatility in its use.

An additional object is to provide a power cylinder embodying self contained brake means which is new and improved as to the means and mode of its function and most simplistically contrived to insure its utmost reliability in use and render it capable of providing precision timing, sequence of function and increments of movememt of interrelated and interacting elements of robotic, material handling, material processing and like systems. A further object is to provide such power cylinders with a braking system featuring new and improved brake shoes.

Another object is to provide a new generation of fluid operated power cylinders which, compared to prior art devices, are commonly characterized by a substantial reduction in their cost, embody a new and improved braking system and elements thereof and have an equal and higher level of performance and reliability in their use.

Another object is to provide a new and improved more universally applicable power cylinder embodying self contained brake means possessing the highly advantageous structural features, the inherent meritorious characteristics and the means and mode of use and operation herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein are shown some but not necessarily the only forms of embodiment of the present invention, FIG. 1 is a perspective view of one configuration and embodiment of a power cylinder having self contained braking means;

FIGS. 2, 3, and 4 each exhibit a similar longitudinal section of the apparatus of FIG. 1 to respectively show the piston assembly and controlling elements thereof in different positions they may assume in the course of a cyclic movement thereof within the cylinder housing;

Figure 9:
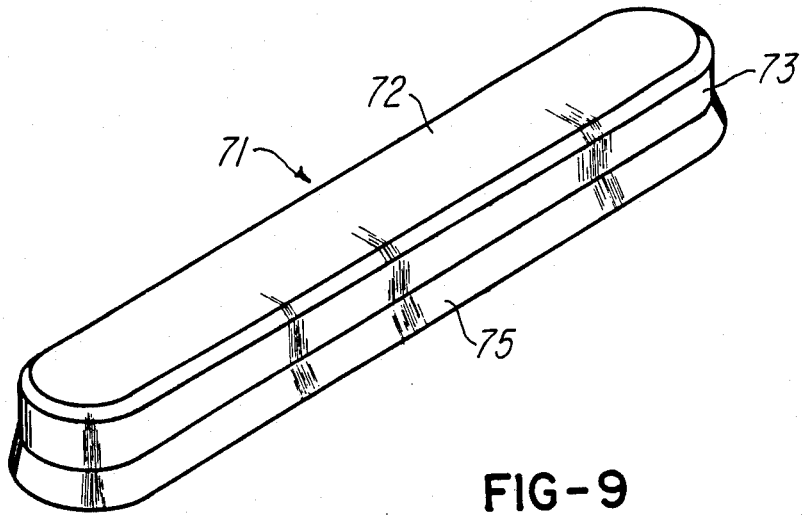
Figure 10:
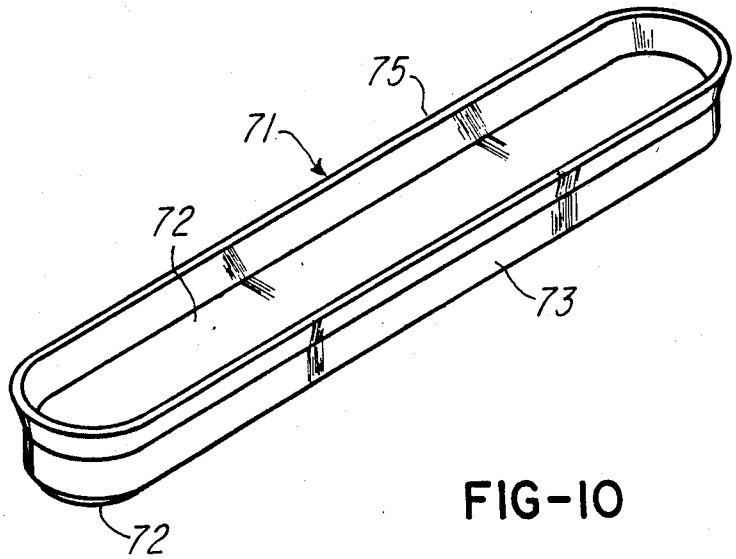
Figure 11:
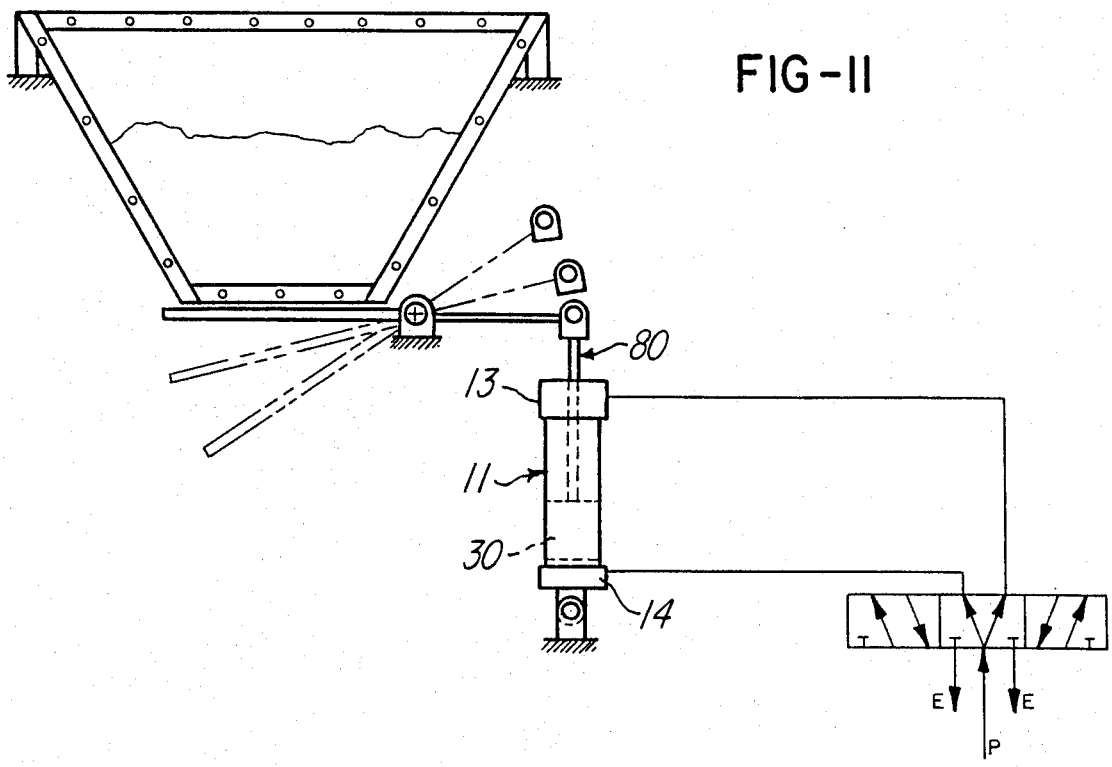
Figure 12:
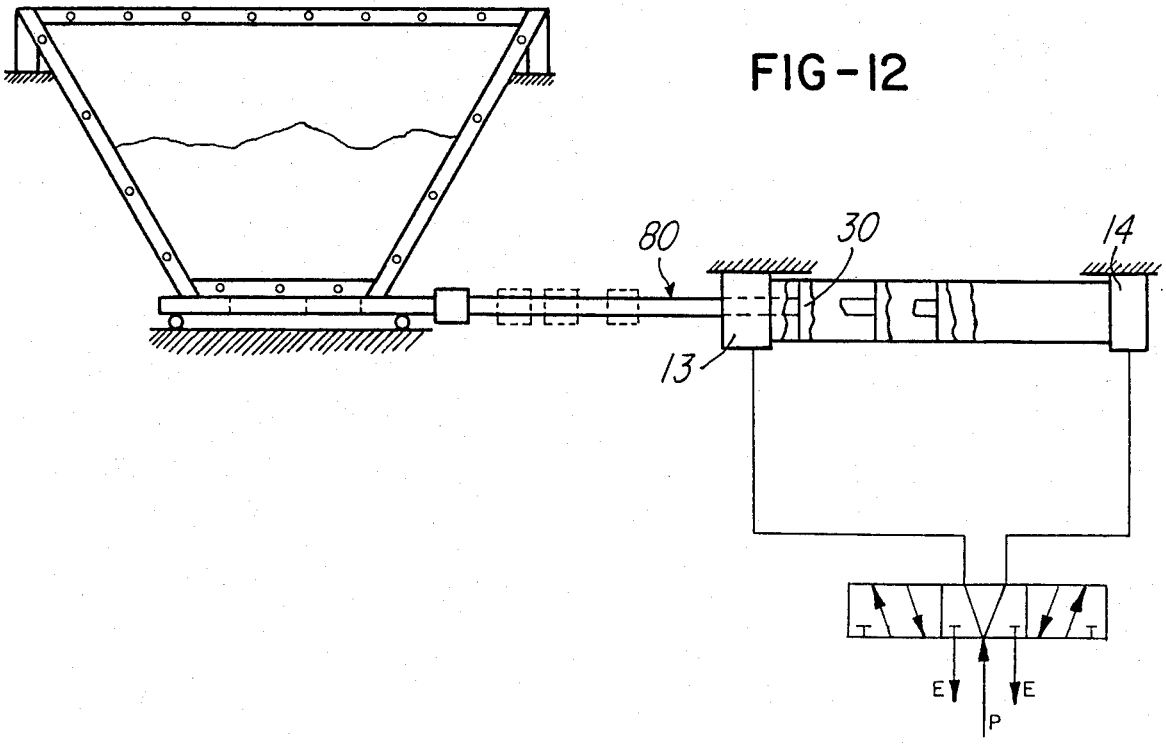
Figure 13:
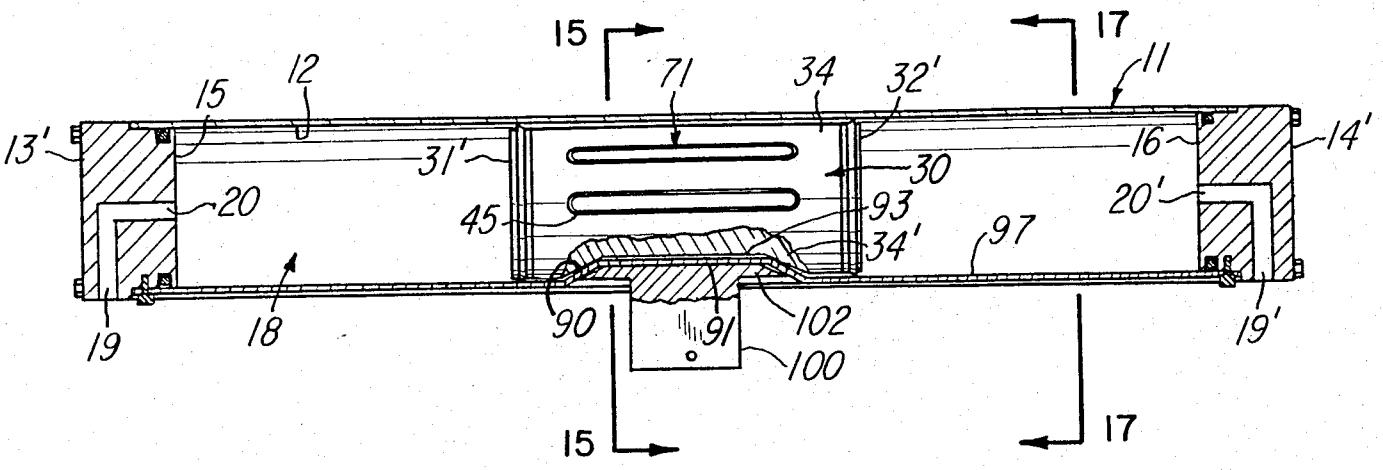
Figures 14, 16, 17, 18:
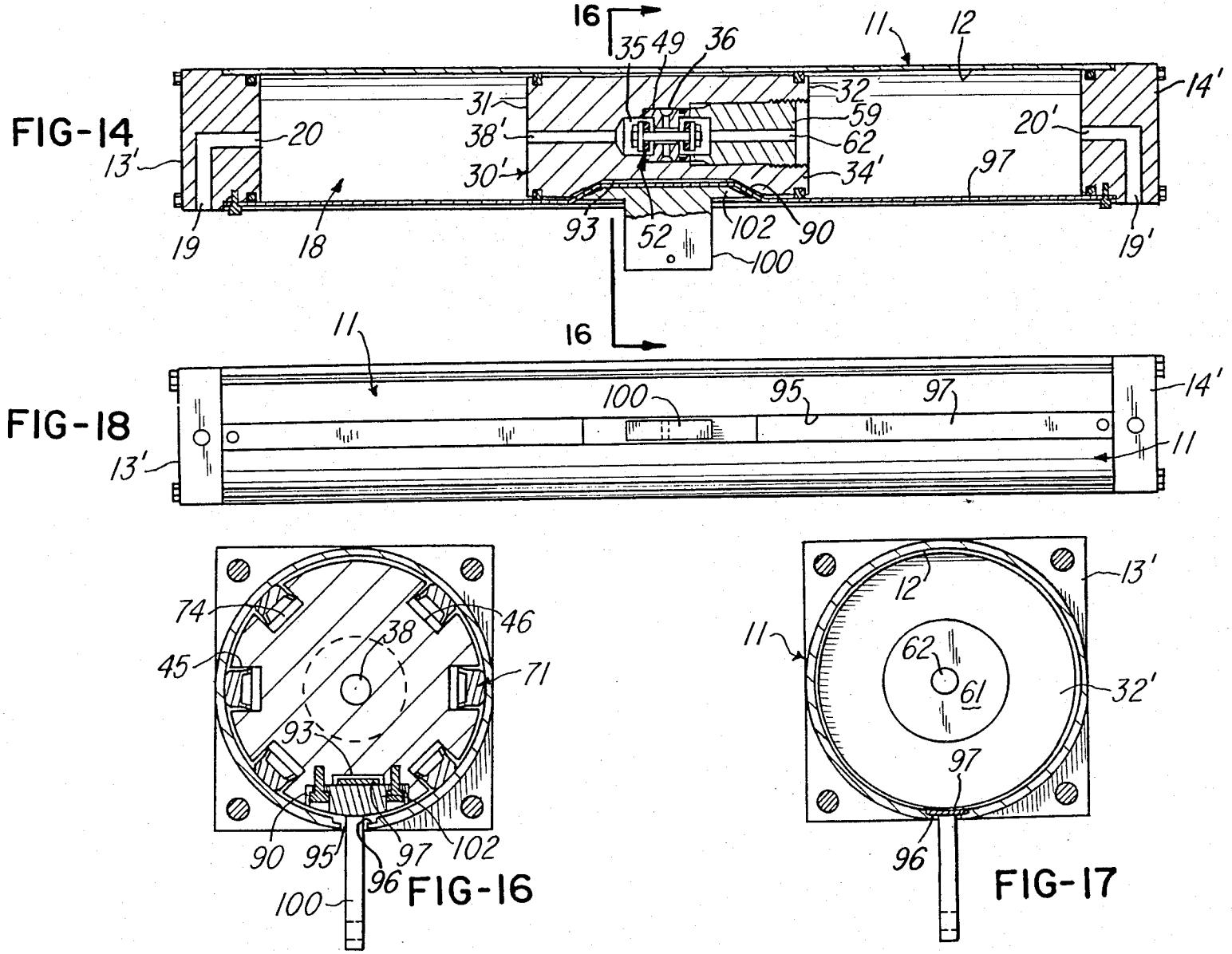

FIG. 9 and 10 respectively exhibit top and bottom perspective views of the brake cup utilized in the piston body of the power cylinder of FIGS. 1–7;

FIGS. 11 and 12 schematically exhibit two different systems and applications of the embodiments of FIGS. 1–10;

FIG. 13 is side elevation view, partly in section, of a rodless power cylinder constituting another embodiment of the invention;

FIG. 14 is a longitudinal section of the piston assembly of FIG. 13.

Figure 15:
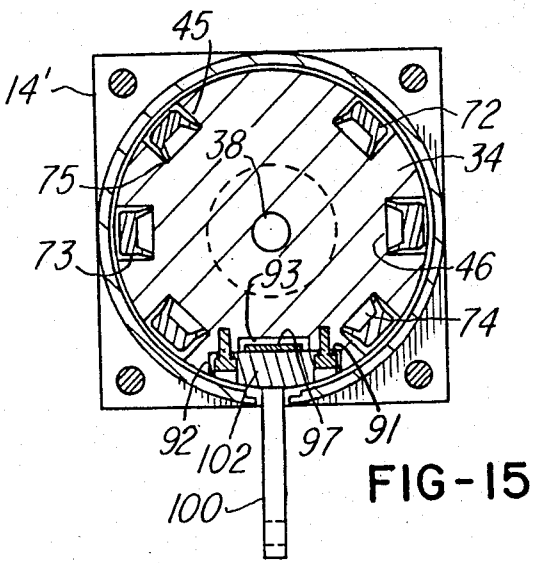

FIG. 15 is a view taken on line 15—15 of FIG. 13 exhibiting a condition wherein the braking system utilized therein, one essentially similar to that demonstrated in FIGS. 1–10, in in an inoperative condition;

FIG. 16 is a view similar to that of claim 15 wherein the braking system is operative;

FIG. 17 is a view taken on line 17—17 of FIG. 13; and

FIG. 18 is a reduced bottom view of apparatus of claim 13;

Like parts are identified by like numbers throughout the several views of the illustrated embodiments and their parts. It should be understood and clearly recognized that the forms of such embodiments as are herein illustrated are purely by way of example and not by way of limitation.

DESCRIPTION OF THE ILLUSTRATED EMBODIMENTS OF THE INVENTION

For convenience, the orientation and relative disposition of elements of the illustrated embodiments of the invention will be herein described in that frame of reference shown in the accompanying drawings.

The embodiment illustrated in FIGS. 1–12 provides a power cylinder comprising a housing 10 and a piston assembly 30.

Housing 10 is comprised of a longitudinally extended tubular body 11, in this instance cylindrical, defining a throughbore 12 the remote open ends of which are capped by rectangular head and cap plates 13 and 14. Centered in one face of each plate 13,14 is a continous groove which nests that end of the body 11 to which it applies as well as an interposed gasket. This arrangement provides joints thus defined between plates 13,14 and the respective ends of body 11 which are tightly sealed as external tie rods, conventionally applied, interconnect, draw together and clamp plates 13,14 against the remote ends of body 11, positioning them in a parallel relation and perpendicular to its central axis.

As so comprised housing 10 defines therein a longitudinaly extended chamber 18 the ends of which are respectively defined by the facing surface portions 15,16 of plates 13 and 14 and the length of which is defined by the inner wall surface portion of the body 11 which bridges said end plates and peripherally bounds throughbore 12.

Head plate 13 has a central aperture 17 which is coaxial with the central longitudinally extending axis of chamber 18. Directed inwardly of and perpendicularly to one side edge portion of plate 13, in a direction radial to the aperture 17, is a blind bore 19. The inner end of bore 19 radially intersects and opens to the inner end portion of a blind bore 20 directed inwardly of and perpendicular to the face 15 of plate 13 at a point within and relatively adjacent the inner wall surface portion of body 11. This arrangement provides a port in housing 10 for the coupling thereto of a line capable of directing pressure fluid to and from that end portion of the chamber 18 the limit of which is defined by the surface 15. Cap plate 14 is provided with similarly positioned, interrelated, intersecting blind bores 19', 20' which likewise define a similar port at the opposite end of housing 10 for like coupling thereto of a line capable of directing pressure fluid to and from the opposite end portion of chamber 18.

Piston assembly 30 mounts in, coaxially of and in bearing relation to that portion of the inner wall surface of body 11 which extends longitudinally of and peripherally bounds chamber 18 and its end surfaces 31 and 32 are in planes perpendicular to the longitudinal axis, and normally in a spaced parallel relation to the end surfaces 15 and 16, of chamber 18.

Piston assembly 30 includes a generally cylindrical body portion 34 which has a through passage which extends from one end thereof to the other. The longitudinal extent of this passage is comprised of four sections 35, 36, 37 and 38, each of which has a different diameter. Three of these sections 35–37 are achieved by means of a blind bore directed inwardly and coaxially of body portion 34 from its extremity 32 the central axis of which coincides with the longitudinally extending central axis of chamber 18 and two successively applied coaxial counterbores. The two counterbores are successively shorter in length and the cross sections thereof are such to successively increase the diameter of successive portions of this blind bore in the direction of end surface 32. The first said counterbore produces, the length thereof, a cylindrically configured bounding wall surface of uniform diameter and at its innermost limit a relatively narrow annular shoulder 39 directed radially inward thereof the plane of which is perpendicular to the central longitudinally extending axis of body portion 34. The second and outermost counterbore produces a cylindrically configured bounding wall surface having a uniform diameter greater than that defined by the first counterbore and at its innermost limit a relatively narrow annular shoulder 40 directed radially inward thereof in a plane parallel to shoulder 39 and end surfaces 31 and 32. An outermost end portion 41 of the length of the wall surface bounding the second of said counterbores is tapped and its outermost extremity, which opens from body portion 34, is rimmed by end surface 32, which resultingly has an annular configuration.

Section 38 of the through passage in body portion 34 is defined by a small diameter bore directed through end surface 31, at a point radially outward of its center, to extend inwardly therefrom in a line so inclined to the central axis of body 34 as to have its innermost end intersect, open to and form an extension of that end of through passage section 35 which is most adjacent end surface 31.

The longitudinal extent of the outer peripheral surface of piston body portion 34 has therein a pair of identical circumferentially extending recesses 43 which are relatively narrow and shallow, spaced longitudinally thereof and in respectively adjacent, spaced, parallel relation to end surfaces 31 and 32. Each recess 43 nests the major portion of the radial extent of a resilient ring seal 44 a radially outermost portion of which disposes in a biased bearing relation to its peripherally bounding wall surface.

Also formed in the outer peripheral surface of body portion 34, between and in spaced relation to recesses 43, are a plurality of circumferentially spaced pockets 45. In this instance each pocket 45 is elongate in form, extends lengthwise of body 34, parallel to the others, and has a depth somewhat greater than that of recesses 43. The longitudinal extent of each pocket 45 is laterally bounded by facing walls which are parallel and equal in length and have their adjacent ends bridged by curved surfaces formed on a uniform radius the apex portions of which are aligned and in a plane centered between and in parallel relation to the planes of said laterally bounding facing wall surfaces. The dimension of each pocket in a direction circumferentially of body 34 is relatively small.

The base surface portions 46 of pockets 45 are radially equidistant from the central axis of body portion 34 and each thereof is intersected, at its center, by the outer end of a radial bore 47 the inner end of which opens to the passage section 35, through its peripherally bounding wall surface, at a point centered between its axial extremities. At the same time the inner ends of bores 47 (FIG. 6), which are circumferentially spaced, commonly open to a groove 48 formed in and extending circumferentially of an axially centered outer peripheral surface portion of a tubular valve body 49 forming part of a valve assembly 50. The indented surface which bounds groove 48 is semi-circular in cross section, has the apex of its arc radially innermost and a radius slightly larger than that of bores 47. Body 49 has a sliding fit in and is coextensive in length with that wall surface which peripherally bounds the passage section 36. As so fit, one annular end surface of body 49 coextensively abuts shoulder 38 while its opposite annular end surface is positioned essentially coplanar with shoulder 40.

The inner wall surface of tubular valve body 49 defines a throughbore coaxial with the central axis of body portion 34 and opens at one end to section 35. This throughbore is distinguished by an identical counterbore 55 at each of its opposite ends the base of one of which defines a radial annular shoulder 56 parallel to surface 31 and in a directly facing relation to section 35 and the base of the other of which defines a similar oppositely facing shoulder 57 which is parallel to end surface 32 and in directly facing relation to the passage section 37. At a location between its shoulders 56 and 57 and in a spaced relation thereto the tubular valve body 49 is intersected by a pair of diametrically opposite radial throughbores 58 the radially outermost ends of which commonly intersect and open through diametrically spaced apex portions of the groove 48. The vavle body 49 is so oriented in the passage section 36 to provide that the throughbores 58 are in direct alignment with and form coaxial extensions of a pair of the bores 47 in the piston body portion 34. The diameters of bores 58 correspond generally with those of bores 47.

Valve body 49 is restrained from axial movement outwardly of section 36 by an end abutted coaxial plug 50 releasably secured within and extending the length of section 37 of the through passage of piston body portion 34. The major portion of the longitudinal extent of the outer peripheral surface of plug 59, including a threaded end portion 50 thereof remote from valve body 49, has a shape and dimension providing it with a complementary bearing fit to and, in part, a threaded engagement with that wall surface which peripherally bounds section 37. As so secured, plug 59 has that end surface portion 61 thereof remote from valve body 49 coplanar with and immediately rimmed by the annular end surface portion 32 of piston body portion 34. Plug 59 is further distinguished by a central axial throughbore 62 of small diameter which at the end thereof remote from surface 61 is enlarged by a counterbore 62' which forms therein a cylindrical pocket which forms a direct extension of the counterbore 55 to which it opens.

A short portion of the axial length of plug 59 including its innermost extremity is uniformly reduced as to its outer diameter to provide that the axially innermost end of the plug has essentially the same dimension as that end surface of valve body 49 which it securely abuts.

The outer surface of valve body 49 has a convergent champfer at its leading end and a circumferential recess therein adjacent and parallel to its opposite end to accommodate conventionally interfit relatively projected ring seals which sealingly bear on the immediate portions of the wall surface bounding the section 36 of the through passage in which valve body 49 is securely but releasably fit.

The valve assembly 50 further includes a shuttle type valving device 52 comprising a rod-like element 51 the central and major portion 63 of the axial extent of which is equidistant from its ends and rectangular in cross section while its end portions 64 are relatively reduced in cross section and have a stepped cylindrical configuration. More particularly, the length of element 51 is greater than the axial extent of valve body 49 and each of its end portions 64 has a part 65 of its length including its outer extremity which is uniformly threaded and has an outer diameter which is slightly larger than that of part 66 thereof which extends between part 65 and the adjacent end of said rectangular portion 63. Because of the differential configuration and cross sectional dimension of rod portion 63 and parts 66, the joints therebetween produce on each end of part 63 an outwardly facing shoulder defining an abutment surface for the radially innermost part of a backing ring 68 slip fit over and inwardly of the adjacent end of the element 51. Each ring 68 backs a sealing ring 69 which is adherently applied to and about the immediately adjacent end of the outer peripheral surface of the rod portion 63. Each ring 68 is clamped to the shoulder which it abuts by a lock nut 70 applied to and about the immediately adjacent end part 65 of the element 51, thereby to complete the shuttle device 52. As will be seen in the drawings, the radially outermost portions of the seals 69 respectively dispose outward of and in respectively facing relation to the shoulders 56 and 57. As will be further seen the shuttle device 52 is a secondary piston capable of being reciprocally moved the stroke of which is short and the limits of which are defined by the respective positions of the shoulders 56 and 57.

Each pocket 45 in the outer peripheral surface of piston body portion 34 nests a brake shoe 71. Each shoe 71 has a cup shape which comprises a narrow elongate base portion 72 the configuration of which is essentially identical to and provides a reduced dimension reproduction of the configuration of the cavity defined by the pocket to which its applies. In this instance the base portion 72 is relatively thick, its axially spaced outer and inner surfaces are essentially planar and parallel and its peripherally bounding outer wall surface 73 is substantially perpendicular to the outermost of its axially spaced surfaces. Integrally connected with said inner surface of base 72, at and coextensive in length with its outer peripheral edge portion, is the base or inner end of an axially projected relatively shallow wall 75 which peripherally bounds and defines the cavity of shoe 71. Wall portion 75 is formed to be relatively thin and uniformly divergent as it projects outwardly from its base 72 and to provide that its outer surface defines a direct coaxial extension of the surface 73 while its outwardly projected extremity which defines the lip of the cup is so dimensioned and formed that on the installation of the brake shoe in its pocket it sealingly and frictionally bears on the wall surface peripherally bounding such pocket, coextensive therewith. The shoe 71 is preferably a molded shoe made of a high strength plastic having a degree of flexibility facilitating its application to pocket 45 and providing a most stable balance and application thereof in its use.

In application of each brake shoe to its pocket 45, it is inverted so that its base portion 72 is positioned outermost and lip 75 innermost. In the inoperative position of the shoe its lip 75 is immediately of the pocket base 46. As thus assembled in an inverted condition, each brake shoe fully bridges the pocket to which it applies, its wall portion 75 forms a shallow dependent divergent skirt and the lip thereof firmly and frictionally bears on and adheres to its bounding wall surface to form thereby a cavity 74 behind the shoe, the base of which cavity is the pocket base 46. Open to cavity 74, through its base, is the radially outermost end of a bore 47.

A blind bore 76 directed inwardly of and perpendicular to end surface 31 of piston body portion 34 is coaxial with and has its innermost end short of and in spaced relation to that end of section 35 of the through passage of piston body portion 34 most adjacent thereto. A tapped outermost end portion of bore 76 is threadedly engaged by one end portion of a piston rod 80 which extends therefrom, coaxially therewith, to and through the aperture 17 in head plate 13, in bearing relation to its bounding wall surface (a ring seal being interposed therebetween) and outwardly therefrom. The innermost end portion of bore 76 provides a chamber 77 communicating by means of a radial bore 78 in piston body portion 34 with a very limited radial space which is peripheral to its outer circumferentially extending surface and between it and the inner surface portion of tubular body 11, the limits of the axial extent of which space are defined by the radially projected portions of seals 44. The piston per se has a small diameter axial throughbore 81 the inner end of which opens to chamber 77 and a short reduced diameter outer end portion 79 which is threaded. At a point immediately adjacent but short of its threaded outermost end portion, which is relatively reduced in diameter, rod 80 per se has a radial bore 82 the innermost end of which opens to bore 81 and the outermost end of which opens to the atmosphere.

Valve assembly 50, and in particular its shuttle device 52, which constitutes a secondary piston, has a multiple function leading to a most simplistic, most effective use and universal application of embodiment of the present invention.

A should be self evident from the foregoing illustrative embodiment of the invention, both by way of description and the accompanying drawings, port 19',20' communicates with one end of the chamber 18 and does by way of the throughbore 62 likewise communicate with counterbore 62' and the immediate end portion of the secondary piston 52 and if the seal 69 of the latter, backed by the ring 68 and lock nut 70, is displaced from shoulder 57 of valve body 49, it also communicates with the cavities 74 and brake shoes 71. Also obvious is the fact that port 19,20 similarly communicates with the opposite end portion of the secondary piston 52 and cavities 74 and brake shoes 71 by way of the opposite end of chamber 18 and sections 38 and 35 of the through passage in piston body portion 34, if the seal portion of said opposite end portion of the secondary piston 52, backed by the ring 69 and lock nut 70, is displaced from shoulder 56 of valve body 49.

Figure 1:
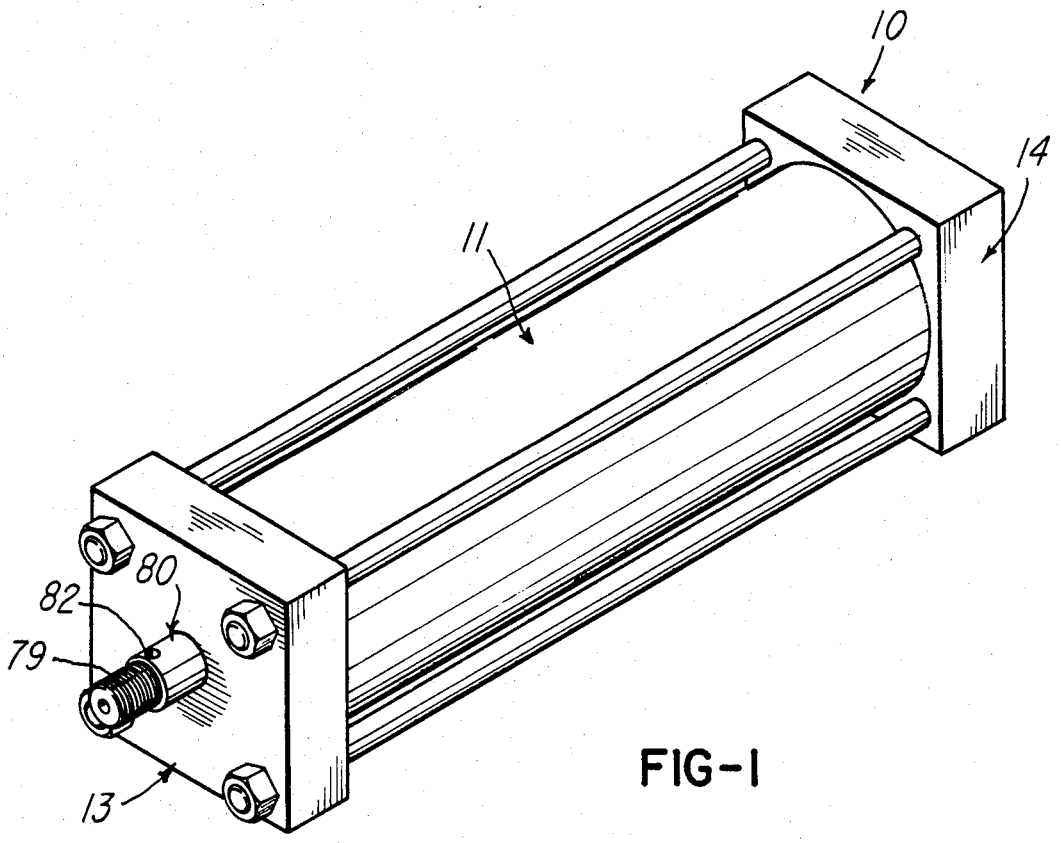
Figure 2:
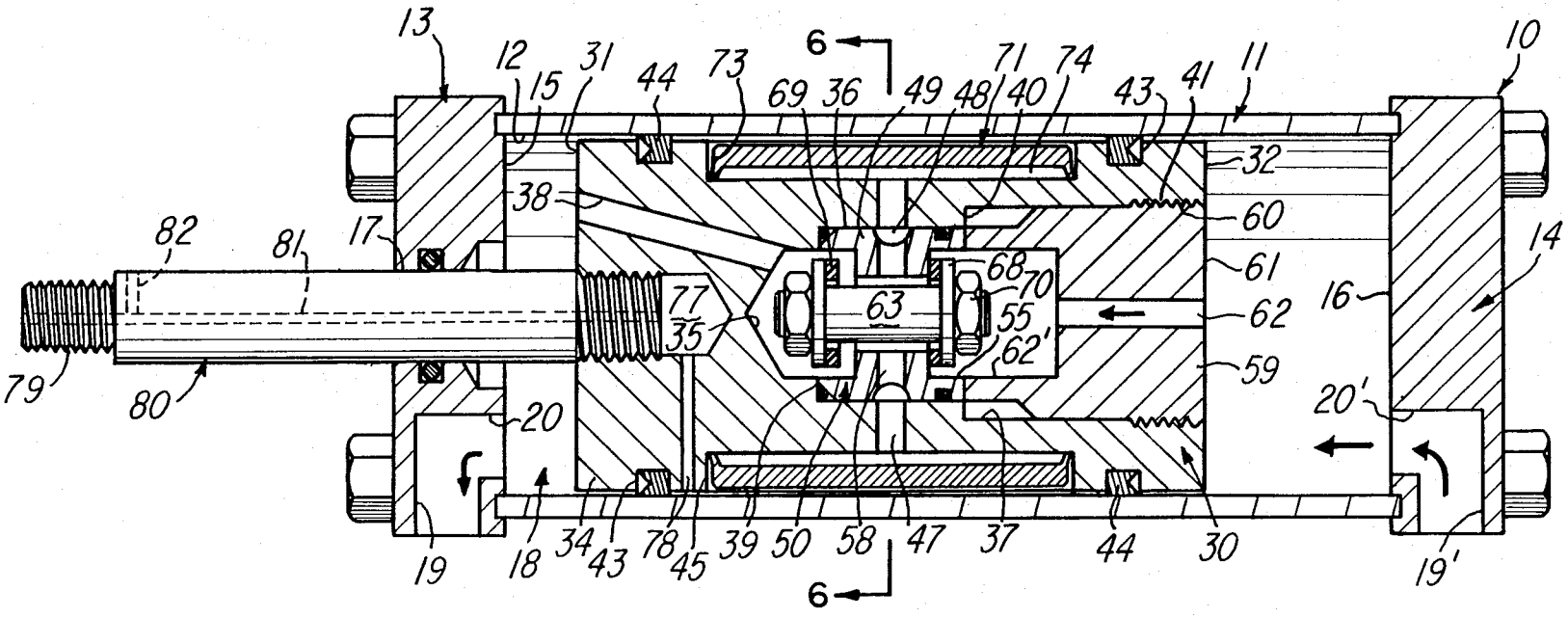
Figure 3:
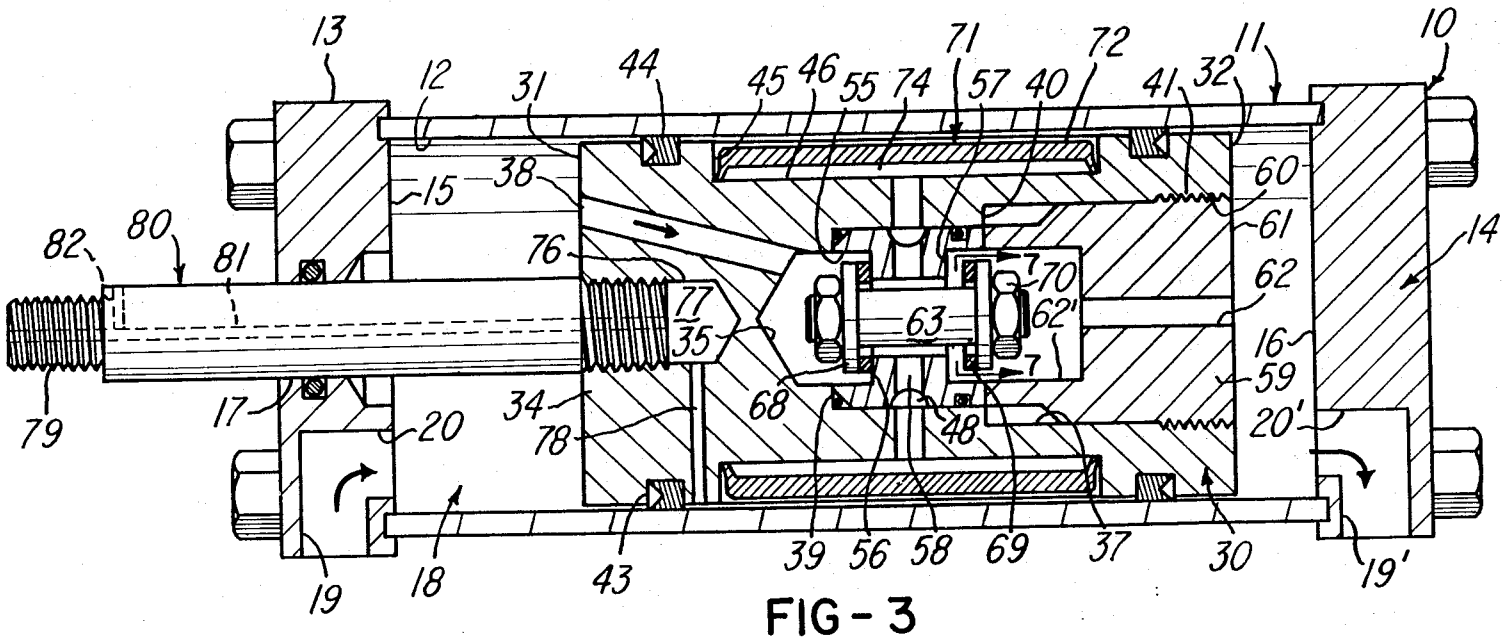

From the foregoing it should be further obvious that if fluid under pressure is introduced to only one end of the chamber 18, for example by way of port 19',20' as shown in FIG. 2, as it is initially introduced and applied against the surface 32,61 of the piston assembly 30, a portion thereof will simultaneously fill throughbore 62,62' and pressure the seal assembly at that end of the secondary piston 52 to which it applies to form a seal across the shoulder 57 and block flow of any portion thereof to the brake shoes. Of course, at the same time the piston assembly 30 will be pressured to move in the same direction as the secondary piston 52, namely towards head plate 13. Correspondingly the piston rod 80 will move outwardly of the housing 10 to lend its function to power that apparatus which is coupled thereto. In the event of this direction of movement of piston assembly, port 19,20 will serve to vent fluid from the adjacent end portion of chamber 18 with which it communicates. A reverse movement of the piston assembly 30 and secondary piston 52 is naturally achieved with similar consequences when the fluid under pressure is directed into chamber 18 by way of port 19,20 and port 19',20' is merely used as a vent (FIG. 3).

Figure 4:
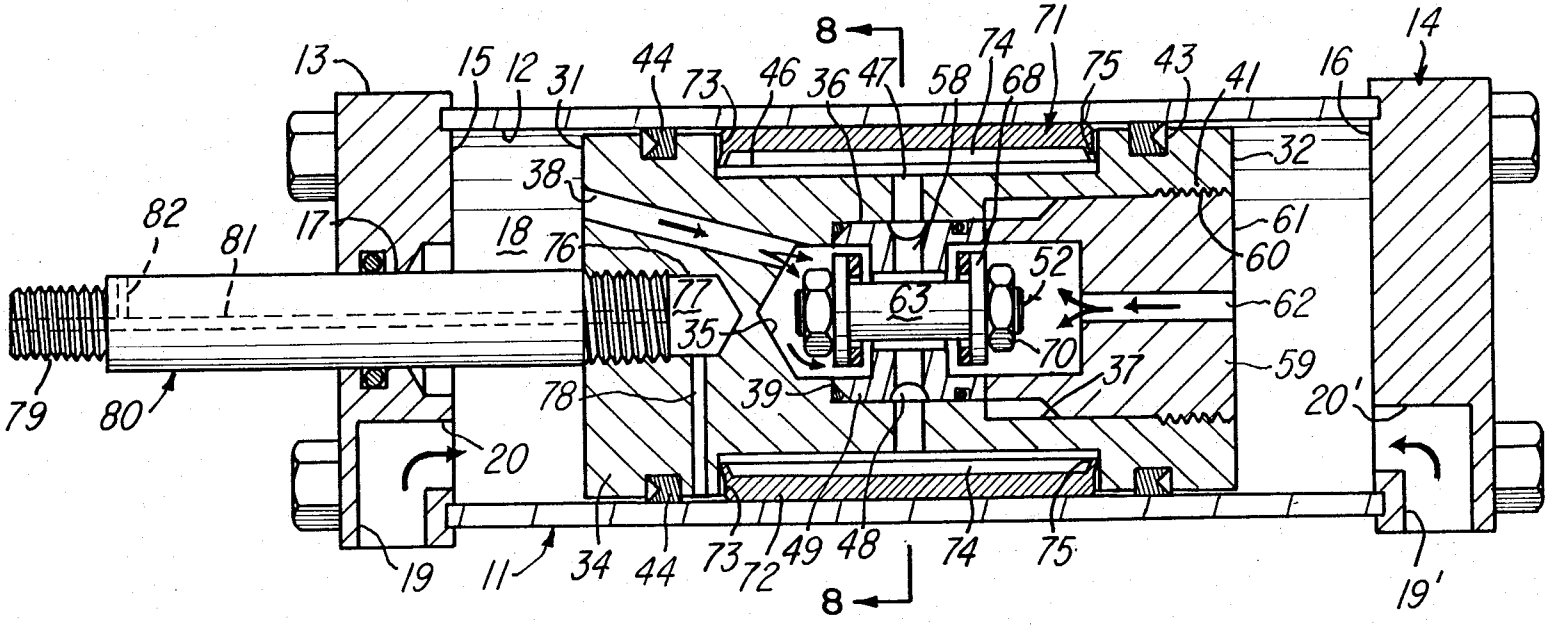
Figure 5:
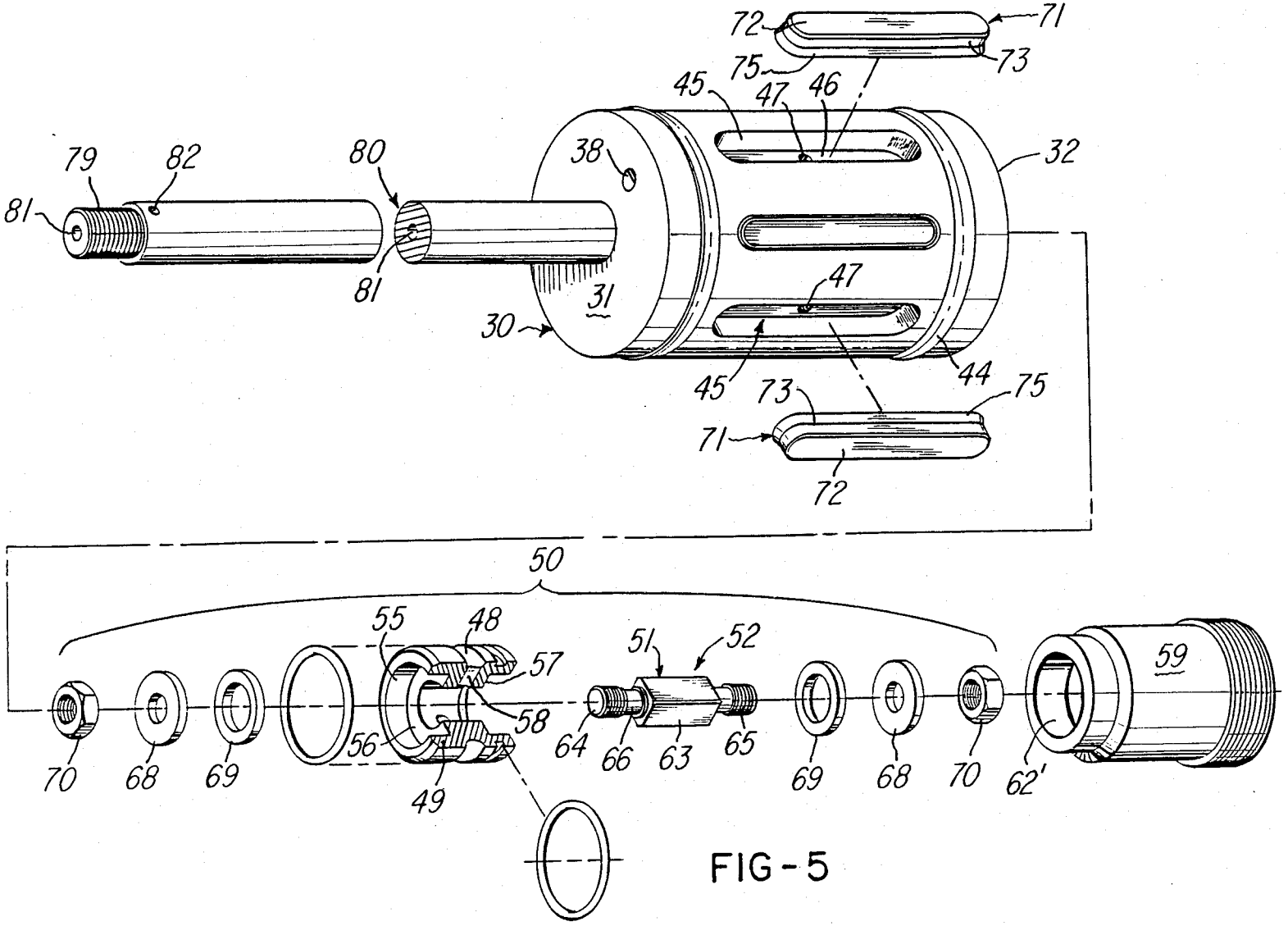
FIG. 5 is an exploded perspective view of the apparatus of FIGS. 1–4.
Figure 6:
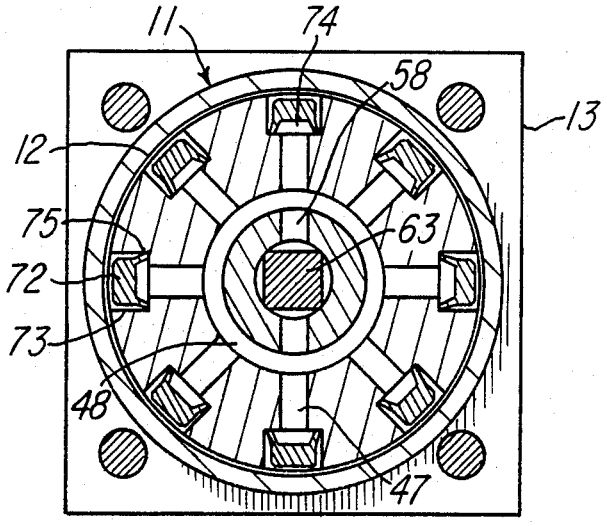
FIG. 6 is a view taken on line 6—6 of FIG. 2.
Figure 7:
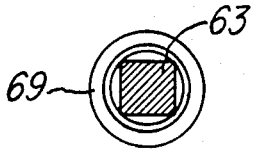
FIG. 7 is a view taken on line 7—7 of FIG. 3.
Figure 8:
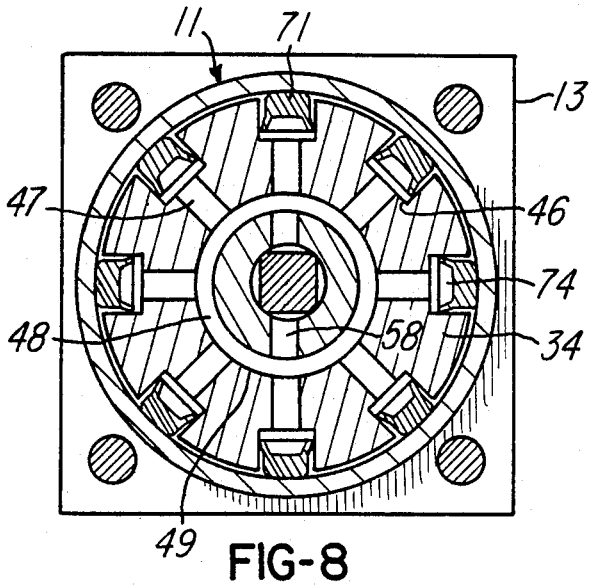
FIG. 8 is a cross sectional view taken on line 8—8 of FIG. 4.

Attention is now directed to FIG. 4 which evidences the ease and speed with which the movements of the piston assembly 30 can be braked, virtually instantaneously. This figure demonstrates, per the present invention, the simultaneous application of fluid under pressure by way of both ports 19,20 and 19'20'. AS this occurs secondary piston 52 is centered with reference to the valve body 49 under which condition the seals 69 are respectively spaced from the respective facing shoulders 56 and 57. Resultingly, pressure fluid commonly flows about the seal assemblies at the respective ends of secondary piston 52, along the four passages defined by the flats the length of the rectangular section 63 of the rod like element 51 with the bounding inner wall surface of the tubular valve body 49 between the flats 56 and 57, to pass through bores 58 and by way of groove 48 simultaneously by way of bores 47 into cavities 74. The consequence of this is a common pressured sliding movement of the brake shoes 71 radially outward to simultaneously, in precisely balanced fashion, frictionally lock against the bounding inner wall surface of the body 11 of the cylinder housing 10.

What has proved to be most significant in the course of extended test is that using inexpensive and very simply related signaling means pressure fluid may be simultaneously directed to and through the ports 19,20 and 19',21' and resultingly moved with such speed as to virtually simultaneously with the entrance of such fluid to the opposite ends of chamber 18 cause the brake shoes 71 to commonly lock to the inner wall surface of body 11. An ancillary aspect of this operation is that the very small bore 78 communicating with the bores 81 and 82 provide a passage to bleed any fluid which prior to the braking procedure is in the extremely limited space peripheral to the piston assembly between the radially projected portions of the seals 44. It would also appear from tests that the cup shape of the brake shoes 71, particularly in the form and mode of application illustrated, contribute to the efficiency and substantially instanteous braking of the piston assembly as and when required.

FIGS. 11 and 12 illustrate, obviously by way of example and not by way of limitation, a very simplistic use of the power cylinder of the invention to selectively brake the piston assembly at selected points along the course of its cyclic movement in the chamber 18 to selectively vary the discharge opening from a hopper from which material must be carefully metered for use in an industrial process. FIG. 11 illustrates the piston 80 as being interconnected with a pivotable closure plate while FIG. 12 demonstrates the metering closure plate as being moved selectively to various positions in the same plane to achieve similar results. The schematic illustrations of FIGS. 11 and 12 are not further detailed or described since they will be self evident to any person versed in the arts to which the present invention relates and applies.

The piston assembly 30 may be connected in various fashion to lend the versatility of the self contained braking means thereof and the ease and speed of the application of the power cylinder of which it forms a part to virtually any one of a number of industrially and domestically required processes and procedures.

The illustrated simplistic applications barely touch the surface of the scope of the application of embodiments of the present invention. What is most significant is that in use of embodiments of the present invention one may virtually instantaneously brake and hold the piston thereof at any point and at numerous points along the length of its stroke and differentially in either direction of its movement, as well as for any selected interval of time, during the course of its movement. More than this the installation and use of a single or multiple of such inexpensive embodiments as here provided will in any case and for any application be very inexpensive and avoid the need for complex and/or more expensive specialized equipment which would otherwise be required to serve the same purpose. In this connection it must be kept in mind one may use a single source of supply of fluid pressure and utilize a simple four way valve for controlling delivery of fluid whether by way of one or two ports at any given instant. This makes it quite clear that whether it be to change the direction of the movement of the piston or to convert to a braking mode or the reverse the change may be virtually instantaneously effected under any condition of use of the cylinder.

FIGS. 13–18 demonstrate a similarly operated embodiment of the invention having the form of a rodless power cylinder the construction of which differs little from that of the embodiment illustrated in FIGS. 1–12. It will therefore be here described only with reference to such differences as exist therein.

In this instance the piston assembly 34, here designated 34', differs from that of FIGS. 1–12 as follows. Due to the elimination of the conventional piston rod, section 38 of the through passage in piston body 34' is directed inwardly of and perpendicular to its end surface 31, at its center, to be coaxial with, open to and form a direct extension of the passage section 35, the bore of valve body 49 and bore 62 of plug 59. Moreover, the outer peripheral surface portion of piston body 34' is here provided with a longitudinally centered, longitudinally extending recess 90. Recess 90 is relatively narrow in width and positioned between and in end spaced relation to the portions of seals 44 which radially project from piston body 34' to sealingly bear on the inner surface of the tubular body 11' of the housing 10' of the illustrated cylinder. Recess 90 is tray shaped in longitudinal section to provide it with a central, generally rectangular base portion 91 and end portions of equal length which slope upwardly therefrom in divergent relation and is laterally bounded by coextensive, parallel, relatively shallow, side walls 92 which are perpendicularly related to its base portion 91. A groove 93 which is rectangular in cross section is formed in and extends the length of the base 91 and end surface portions of recess 90 to be parallel to and laterally centered between the side walls 92.

A further difference is evident in the tubular body portion 11 of housing 10' of the cylinder of FIGS. 13–18, here designated as 11' in that the length of the portion thereof which bounds chamber 18 is provided with a coextensive slot 95 and in the assembly of piston 30 therein this slot extends over the length of recess 90 and is in a direct radial alignment with its groove 93.

Additionally, a narrow, recessed shoulder 96 is formed in the inner surface of body 11', at each of the opposite sides of slot 96 and coextensive therewith. Shoulders 96 are parallel and define a track bearing on which, the length thereof, is a narrow strap 97 of flexible metal which bridges and forms a seal of the slot on completion of assembly of the cylinder of which it forms a part.

Differences are also found in the head and cap plates 13 and 14, here designated 13' and 14' respectively. In this instance facing end portions of these rectangular plates are reduced identically to cylindrical form and telescopically nest in the respective ends of tubular body 11' on their assembly thereto, peripheral ring seals being applied, and at the same time the respective end portions of the flexible slot closure strip 97 are anchored therebetween by suitable releasable fixing elements. One further change in the head and cap plates for the rodless cylinder is that the blind bores 20 and 20' therein are both moved to a position wherein they are coaxial with the piston assembly 34'.

In lieu of a piston rod the cylinder of FIGS. 13–18 is provided with a plate type tongue device 100 having an integral perpendicularly related saddle-shaped base 102 the configuration of which in cross section is complementary to that of the tray shaped recess 90. Prior to the insertion of the piston assembly 30' in the tubular body 11' and the application of the head and cap plates 13', 14' to the latter, the saddle shaped base portion 102 of the tongue device 100 is nested in and seated to the complementary base and end surface portions of recess 90, the width thereof, in the process of which to bridge and tightly cap the extent of groove 93 and be fixed to base portion 91, by screws for example (FIGS. 14 and 16). Groove 93 is thus converted to a passage through which flexible strap 92 is threaded immediately prior to insertion of piston assembly 34' and the so assembled strap to tubular body 11' of the cylinder housing 10'. In the application of this assembly to body 11', as seen from FIG. 16, tongue plate 100 is aligned with and inserted through slot 95 at the cap end thereof as the piston assembly is placed within the body 11' in bearing relation to its wall surface at a point intermediate and spaced from its ends. It is at this point that the portions of the length of strap 97 extending from the respective ends of the saddle shaped base 102 of tongue 100 are brought into their required bridging immediately underlying relation to the slot 95 throughout their length and have their remote extremities attached to body 11' and the head and cap plates, as they are telescopically applied to complete the rodless cylinder of FIGS. 13–18 in the manner above described. As will be self evident, the tongue device 100 now forms a fixed part of the piston assembly 35 and moves therewith in the course of its travel, accomodated by the slot 95 and the flexible nature of the strap 97.

As will be obvious, tongue plate 100, which projects outwardly from and radially of housing 10', serves, like the piston 80 of the embodiment of FIGS. 1–12, as a means for the direct interconnection of piston assembly 34', or piston assembly 34, as the case may be, with an element or elements of interrelated and interacting elements of robotic, material handling, material processing and like systems to exercise, by virtue of the significant improvements of the cylinders of the invention, an assured and essentially fail safe control thereof and provide the required precision of their timing, operation and function.

In addition to the foregoing attention must also be directed to the fact that the cup-shaped brake shoes of the invention are per se worthy of note as an important contribution to the art to which they relate. They afford maximum braking power with limited surface contact, are most durable and most effective for any given size thereof and capable of extended use without malfunction. A particularly preferred form thereof and mode of their application is featured in the illustrative embodiments of power cylinders per the present invention which are herein illustrated by way of example but not by way of limitation.

The invention demonstrates a most positive response to and provides the ultimate and most effective solution of a long standing problem, namely the existing need for more simplistically contrived and more reliable fluid operated controls capable of providing precision timing, sequence of function and increments of movement of interrelated and interacting elements of robotic, material handling, material processing and like systems.

In fact the features and benefits of this invention are that significant as to provide a new generation of fluid operated power cylinders which, as compared to prior art devices having similar application, are commonly characterized by a substantial reduction in their cost and an equal and higher level of performance and reliability in their use and a generally universal application.

It is believed that the foregoing clearly illustrates that the present invention does provide a significant forward step in the art to which it relates.

From the above description it will be apparent that there is thus provided a device of the character described possessing the particular features of advantage before enumerated as desirable, which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

Embodiments of the invention in which an exclusive property of privilege is claimed are defined as follows:

1. A substantially universally applicable power cylinder comprising a housing having a throughbore capped by end plates to define therein a longitudinally extending chamber, a piston assembly having a longitudinally extending body mounting for reciprocal movement in said chamber in bearing relation to that wall surface which bounds the length of said chamber, said piston assembly having a longitudinally extended through passage and including a valve device and functionally related brake means, a portion of said valve device being in communication with said through passage, ports in said housing respectively communicating with respective end portions of said chamber for the selective delivery thereto and discharge therefrom of fluid under pressure and the selective application of said delivered fluid to one or simultaneously to both ends of said piston assembly, said valve device being constructed and arranged to respond to fluid under pressure applied to one end of said piston assembly and the end portion of said through passage at said one end of said piston assembly to effect and maintain a blockage of said through passage as said piston is moved by the pressure of said fluid applied to said one end thereof towards that end of said chamber beyond the opposite end of said piston assembly and to respond to a simultaneous application of pressure fluid to both ends of said piston assembly to utilize the so applied fluid to effect an actuation of said brake means and a virtually simultaneous lock of a portion of said brake means and correspondingly said piston assembly to that portion of the chamber wall surface which is then in peripherally bounding relation thereto.

2. A power cylinder as in claim 1 characterized in that said portion of said valve device in connection with said through passage is a secondary piston including means to each of its opposite ends to selectively produce said blockage of said through passage on application of fluid under pressure to one or the other ends of said piston assembly.

3. Apparatus as in claim 1 wherein said brake means includes cup shaped braking elements which are normally releasably retained in and in an aligned circumferentially spaced relation to an intermediate portion of the length of the outer peripheral surface of said piston assembly.

4. Apparatus as in claim 3 wherein said cup shaped braking elements are respectively retained in complementarily shaped individual pockets formed in said outer peripheral surface of said piston assembly, inverted to have their lip portion which bounds the mouth thereof innermost of the pocket in which they are maintained and such lip portion formed to be outwardly divergent to normally frictionally engage the surface of said pocket which is in peripherally bounding relation thereto.

5. Apparatus as in claim 3 wherein said valve device is functionally related to said braking elements by linking passages communicating with said valve device and said longitudinally extended through passage of said piston assembly with the interior of the respective pockets and the interior of a cavity defined by each said inverted cup shaped braking element with the innermost portion of the pocket in which it is retained to receive therein, on a simultaneous application of pressure fluid to both ends of said piston assembly, a flow of the so applied pressure fluid virtually immediately of said simultaneous application of pressure to effect said actuation of said braking elements to immediately thereof lock said piston assembly to said bounding wall surface.

6. Apparatus as in claim 1 wherein said longitudinally extending through passage is coaxial with said ports.

7. Apparatus as in claim 1 wherein said brake means comprises a body including a portion presenting a braking surface, said portion has in backing relation thereto a substantially axially projectd, integrally formed, stabilizing wall structure lending it rigidity and support and means for mounting said brake means to said piston assembly for its intended use.

8. Apparatus as in claim 7 wherein said body portion of said brake means has a narrow elongate form and said wall structure defines thereon a shallow divergent skirt-like axial extension providing means for frictionally mounting said brake means for its intended use.

9. A power cylinder comprising a housing, a longitudinally extending chamber defined in said housing, means defining a port adjacent each of the opposite ends of said chamber for the delivery thereto and the exit therefrom of fluid under pressure, a piston assembly mounted for reciprocation within said chamber in bearing relation to a wall surface portion thereof which peripherally bounds its longitudinal extent, said piston assembly including a through passage, valve means interposed in said through passage intermediate the opposite ends thereof, said piston assembly including brake means in communication with said valve means, said valve means including means responsive to application of fluid under pressure to one end of said piston body to close said through passage and prevent the movement of the applied fluid therethrough to the opposite end of said chamber, in the course of which to produce a movement of said assembly towards said opposite end of said chamber and said valve means being constructed and arranged to respond to the simultaneous application of pressure to both ends of said piston assembly, by way of said ports, to substantially simultaneously therewith activate said brake means to fix said piston assembly in place to the portion of said wall surface by which it is peripherally bounded at that time.

10. Apparatus as in claim 9 wherein said brake means includes inverted cup shaped braking elements which are relatively aligned and nested in outer peripheral surface portions of said piston assembly.

11. Apparatus as in claim 10 wherein said inverted cup shaped braking elements are in an aligned circumferentially spaced relation.

12. Apparatus as in claim 9 wherein said brake means includes cup shaped braking elements releasably retained in and in an aligned circumferentially spaced relation to a portion of the length of the outer peripheral surface of said piston assembly and are elongated in a direction lengthwise thereof.

13. A substantially universally applicable power cylinder comprising a longitudinally extending shell-like tubular housing the ends of which are capped to define therein an axially extended chamber, a piston assembly including a piston body embodying self contained brake means mounted for reciprocation in and in bearing relation to a wall surface portion of said housing which is in peripherally bounding relation to said chamber and extends the length thereof, means defining a port adjacent each of the opposite ends of said chamber for the selective delivery and application of pressure fluid to one or the other or simultaneously to both ends of said piston assembly and the exit of said fluid from said chamber, said piston body being distinguished by a longitudinally extending through passage a section of the length of which intermediate its ends is bridged by a valve assembly including a tubular valve housing mounted for reciprocal movement within the throughbore of which, in bearing relation to a bounding wall surface portion thereof, is an intermediate portion of the length of a shuttle type valving device the length of which is greater than that of said throughbore and has means in connection with each of the respective ends thereof which in response to the application of fluid under pressure to the adjacent end of said piston assembly produces a seal of said passage preventing fluid from moving to the remote end of said chamber and insures movement of said piston assembly towards said remote end of said chamber, said valve assembly being constructed and arranged to respond to a simultaneous application of pressure fluid to the respective ends of said piston assembly to direct pressure fluid applied to both ends theroef to activate said brake means to substantially simultaneously fix said piston assembly to a portion of said wall surface which peripherally bounds said chamber.

14. Apparatus as in claim 13 wherein said brake means includes inverted cup shaped braking elements normally nestd in and spaced circumferentially of the outer peripheral surrface portion of said piston body.

15. Apparatus as in claim 14 wherein said longitudinally extending through passage in said body is an axial passage and all portions thereof are coaxially aligned.

16. Apparatus as in claim 15 wherein said ports are coaxially aligned with said longitudinally extending through passage.

* * * * *

UNITED STATES PATENT AND TRADEMARK OFFICE

CERTIFICATE OF CORRECTION

PATENT NO. : 4,825,746

DATED : May 2, 1989

INVENTOR(S) : Ray H. Herner

It is certified that error appears in the above-identified patent and that said Letters Patent is hereby corrected as shown below: Title page:

Abstract, last line, "realton" is corrected to read --relation--.

Col. 1, line 44, the semicolon is deleted.

Col. 2, line 33, "simultaneouslsy" is corrected to read -- simultaneously --.

Col. 3, line 57, "in" (first occurrence) is corrected to read -- is --

Col. 4, line 33, "perpendicularly" is corrected to read -- Perpendicular --.

Col. 5, line 58, "35" is corrected to read -- 36 --.

Col. 6, line 22, "vavle" is corrected to read -- valve --;

line 34, "50" is corrected to read -- 60 --.

Col. 13, line 46, "projectd" is corrected to read -- projected--.

UNITED STATES PATENT AND TRADEMARK OFFICE

CERTIFICATE OF CORRECTION

PATENT NO. : 4,825,746

DATED : May 2, 1989

INVENTOR(S) : Ray H. Herner

It is certified that error appears in the above-identified patent and that said Letters Patent is hereby corrected as shown below:

Col. 14, line 54, (claim 13, line 33), "theroef" is corrected to read -- thereof --.

Col. 14, line 60, (claim 14, line 3) "nestd" is corrected to read -- nested --.

Col. 14, line 61, (claim 14, line 4) "surrface" is corrected to read -- surface --

Signed and Sealed this

Twenty-third Day of January, 1990

*Attest:*

JEFFREY M. SAMUELS

*Attesting Officer* *Acting Commissioner of Patents and Trademarks*